US005553357A

United States Patent [19]

Kim et al.

[11] Patent Number: 5,553,357

[45] Date of Patent: Sep. 10, 1996

[54] HIGH BULKY WOOL SPUN YARN AND A DRAFTING APPARATUS FOR PREPARING THE YARN

[75] Inventors: Kun-hye Kim; Soo-ho Son; Young-huy Yoon; Chang-jig Lee, all of Seoul, Rep. of Korea

[73] Assignee: Cheil Industries, Inc., Taegu, Rep. of Korea

[21] Appl. No.: 367,595

[22] Filed: Jan. 3, 1995

[30] Foreign Application Priority Data

Nov. 16, 1994 [KR] Rep. of Korea ..... 94-30021

[51] Int. Cl.[6] ..... D01H 5/78

[52] U.S. Cl. ..... 19/258; 19/244; 492/31; 492/35

[58] Field of Search ..... 19/236, 237, 244, 19/251, 258, 259, 262, 265, 266; 57/315, 217; 492/28, 29, 30, 31, 33, 34, 35, 36, 37; 28/219, 220, 240, 243

[56] References Cited

U.S. PATENT DOCUMENTS

| | | | |
|---|---|---|---|
| 41,333 | 1/1864 | Weild | 492/35 |
| 54,067 | 4/1866 | Fuller | 19/258 |
| 709,694 | 9/1902 | Bietenholz | 492/34 |
| 2,077,312 | 4/1937 | Donald | 19/258 |
| 2,223,589 | 12/1940 | Weinberger | 19/258 |
| 2,244,461 | 6/1941 | Kettley | 19/258 |
| 2,787,811 | 4/1957 | Klein | 19/265 |
| 3,153,316 | 10/1964 | Livingston | 57/208 |

FOREIGN PATENT DOCUMENTS

| | | | |
|---|---|---|---|
| 2163 | of 1859 | United Kingdom | 492/35 |

*Primary Examiner*—C. D. Crowder
*Assistant Examiner*—Larry D. Worrell, Jr.
*Attorney, Agent, or Firm*—Woodcock Washburn Kurtz Mackiewicz & Norris

[57] ABSTRACT

A high bulky wool spun yarn for knitting or weaving, which has high bulky properties formed by bulky loops in the bundle of the yarn, and a drafting system for making the same is provided. The drafting system includes a spinning machine with an improved front top roller that periodically changes the contacting points of a wool roving to form uniform bulky loops in a bundle of a wool spun yarn, thereby forming the high bulky wool spun yarn. Multiple grooves which are perpendicular to the axis of the top roller are formed on the surface of the top roller. Additionally, multiple slanting grooves which are slanted at about 45° to the axis of the top roller or to the multiple grooves are formed on the surface of the top roller. Abrasion resistant fillers are inserted and fixed in the multiple slanting grooves.

16 Claims, 5 Drawing Sheets

HIGH BULKY WOOL SPUN YARN AND A DRAFTING APPARATUS FOR PREPARING THE YARN

FIELD OF THE INVENTION

The present invention relates to a wool spun yarn with bulky loops in the bundle of the yarn. More particularly, the present invention relates to a wool spun yarn for knitting or weaving, which has a high bulky property by forming bulky loops in the bundle of the yarn.

The present invention also relates to a drafting apparatus of a spinning machine, which provides a yarn with a high bulky property. More particularly, the invention relates to an improved front top roller of the drafting apparatus in a spinning machine, which periodically changes the contacting points of a wool roving so as to form bulky loops in the bundle of a spun yarn.

The invention includes also a process of preparing a wool spun yarn with bulky loops by using the front top roller of this invention and a high bulky wool spun yarn prepared by the process.

BACKGROUND OF THE INVENTION

In a wool spun yarn for knitting or weaving, various researches have focused on a soft touchness and a high bulkiness of the wool spun yarn and fabric through pretreatment of raw wools, fore spinning, spinning or dyeing. Particularly, it has been difficult to provide a wool spun yarn for knitting and a kntting wear with a high bulkiness.

The major problems in preparing the wool spun yarn for knitting and a knitting wear with a high bulkiness are an instability of physical properties and a pilling problem on the knitting fabric. The conventional wool spun yarn for knitting does not have uniform bulky loops in the bundle of the yarn, exhibits a poor bulkiness and causes an instability of physical properties. Also the conventional wool spun yarn exhibits a pilling phenomenon on the surface of a wool fabric. The pilling phenomenon is caused by fibrils of the bundle of a wool spun yarn.

In order to improve the bulkiness, pilling phenomenon and physical properties of the wool spun yarn or wool fabric, the present inventors develop a drafting apparatus for preparing a high bulky wool spun yarn. The present invention may be applied to a wool spun yarn for weaving as well as for knitting. The present invention has effects that the wool spun yarn has a high bulkiness by forming uniform bulky loops in the bundle of the yarn, that the wool fabric knitted or woven with the spun yarn has a good soft-touchness, that the wool fabric is light-weighted, and that the spun yarn can save the raw materials of wool.

OBJECTS OF THE INVENTION

An object of the present invention is to provide a high bulky wool spun yarn with uniform bulky loops in the bundle of the yarn.

Another object of the invention is to provide a high bulky wool yarn with no fibrils on the surface of the yarn so as to prevent a pilling phenomenon.

Further object of the invention is to provide a high bulky wool yarn which renders a good soft-touchness to a fabric of the yarn, saves raw materials of wool, and is light-weighted.

Further object of the invention is to provide a drafting apparatus for and a process of preparing the high bulky wool spun yarn.

SUMMARY OF THE INVENTION

The present invention relates to a high bulky wool spun yarn for knitting or weaving, which has a high bulky property by forming bulky loops in the bundle of the yarn.

In a drafting system of a spinning machine, the present invention relates to an improved front top roller of the drafting system, which periodically changes the contacting points of a wool roving so as to form uniform bulky loops in the bundle of a wool spun yarn. In the front top roller, multiple grooves which are perpendicular to the axis of the top roller are formed on the surface of the top roller, multiple slanting grooves which are slanted at about 45° to the axis of the top roller or to the multiple grooves, are formed on the surface of the top roller, and abrasion resistant fillers are inserted and fixed in the multiple slanting grooves. The high bulky wool spun yarn of this invention is prepared by using the front top roller in the drafting system of a spinning machine.

The drafting system of a spinning machine for spinning a wool spun yarn consists of a back roller part, a middle roller part, and a front roller part. A wool roving is drafted into a wool spun yarn in the drafting system. More particularly, a first draft of the wool roving is performed between the back roller part and the middle roller part, and a second draft is performed between the middle roller part and the front roller part.

The front top roller of the front roller part is used to form uniform bulky loops in the bundle of the spun yarn by periodically changing the contacting points of a wool roving.

The embodiments of this invention will be clearly described with reference to the drawings attached.

DETAILED DESCRIPTION OF THE INVENTION

A wool spun yarn is prepared by carrying out a series of processes comprising combing, fore spinning, spinning, and clearing. When a dyed wool spun yarn is prepared, a dyeing process is carried out before combing or after spinning. In order to prepare a wool spun yarn with a good quality, there have been various developments on pretreatment of the raw materials of wool, combing, fore spinning, spinning, clearing or dyeing.

Figure 1:
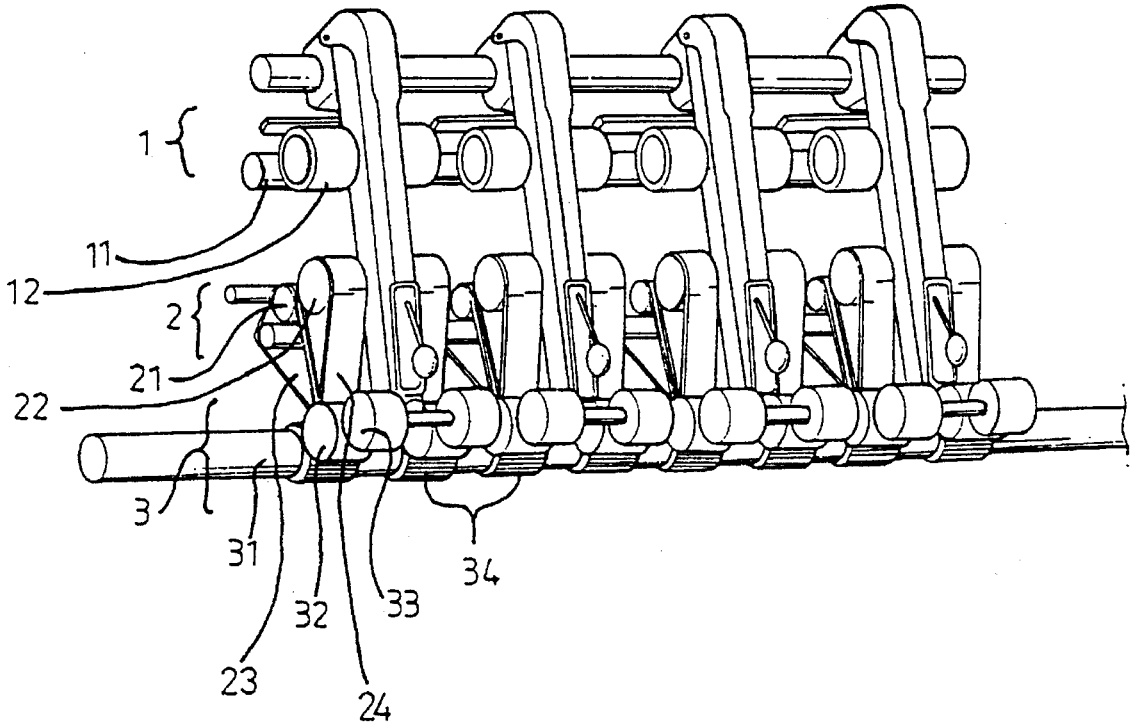
FIG. 1 is a perspective view of a drafting system of a spinning machine.

The present invention relates to a spinning process, particularly to a drafting apparatus of a spinning machine. FIG. 1 illustrates schematically a perspective view of a drafting apparatus of a spinning machine. The drafting apparatus consists of a back roller part 1, a middle roller part, 2 and a front roller part 3. The back roller part 1 consists of a back bottom roller 11 and a back top roller 12. The middle roller part 2 consists of a middle bottom roller 21, a middle top roller 22, a bottom rubber apron 23, and a top rubber apron 24. And the front roller part 3 consists of a front bottom roller 31, a front top roller 32, and a cleaning roller 33.

A wool roving is passed between the back bottom roller 11 and the back top roller 12, between the bottom rubber apron 23 and the top rubber apron 24, and then between the front bottom roller 31 and the front top roller 32. The wool roving is drafted by passing the drafting apparatus so that a wool spun yarn is prepared. The wool spun yarn is taken up on a cop.

A wool roving is drafted into a wool spun yarn in the drafting system. Particularly, a first draft of the wool roving is performed between the back roller part 1 and the middle roller part 2, and a second draft of the wool roving is performed between the middle roller part 2 and the front roller part 3. The draft ratio of the first draft is usually in the range of 1.0 to 2.0, and the draft ratio of the second draft is usually in the range of 12 to 20.

Figure 2:
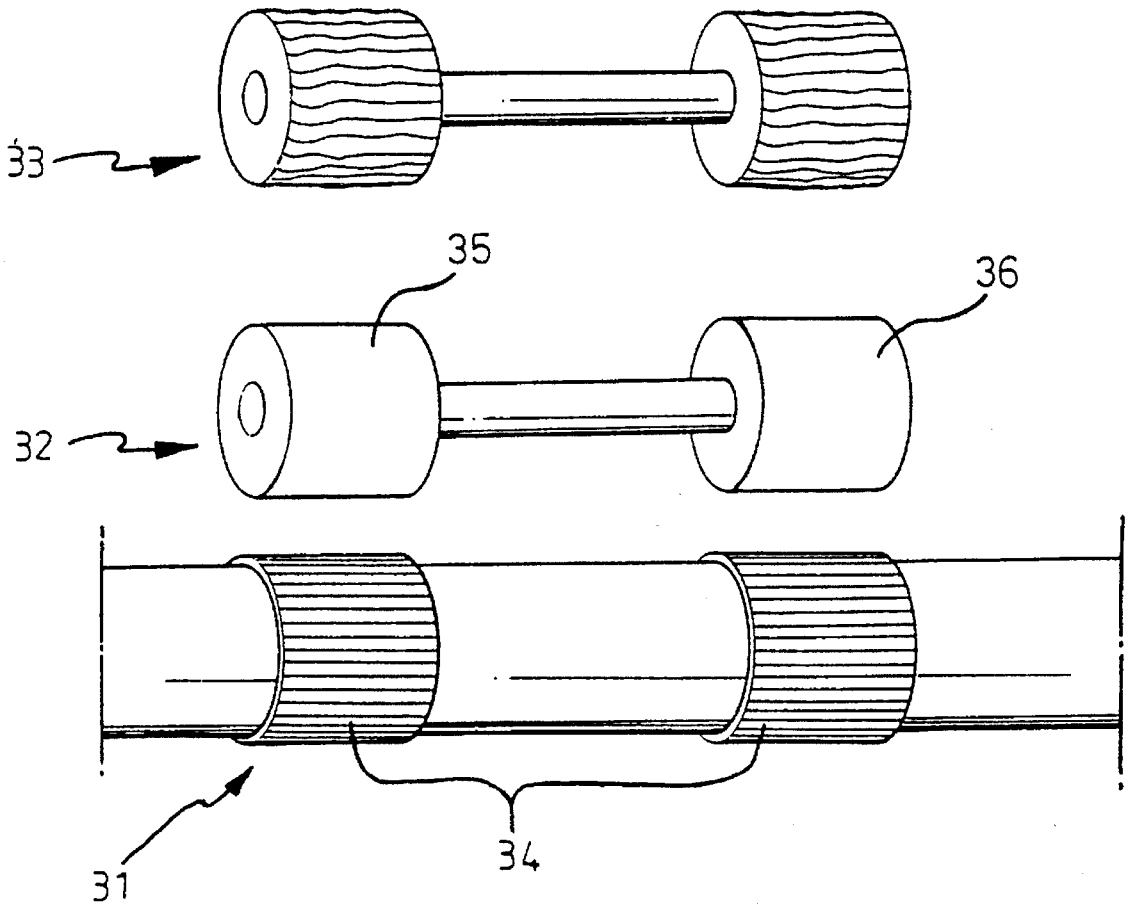
FIG. 2 is an exploded plan view of the front roller part of the drafting system.

This invention relates to the front roller part 3, particularly to the front top roller 32. The front roller part 3 consists of a front bottom roller 31, a front top roller 32, and a cleaning roller 33. FIG. 2 is an exploded plan view of the front roller part 3 of the drafting system.

The front bottom roller 31 has drafting surfaces on which the multiple grooves parallel to the axis of the roller 31 are formed, which contact with the surfaces of the rubber groove rollers 35 and 36 in order to draft a wool roving. The cleaning roller 33 is covered with a cloth. The cleaning roller 33 rotates to remove impurities on the front top roller 32.

Figure 3:
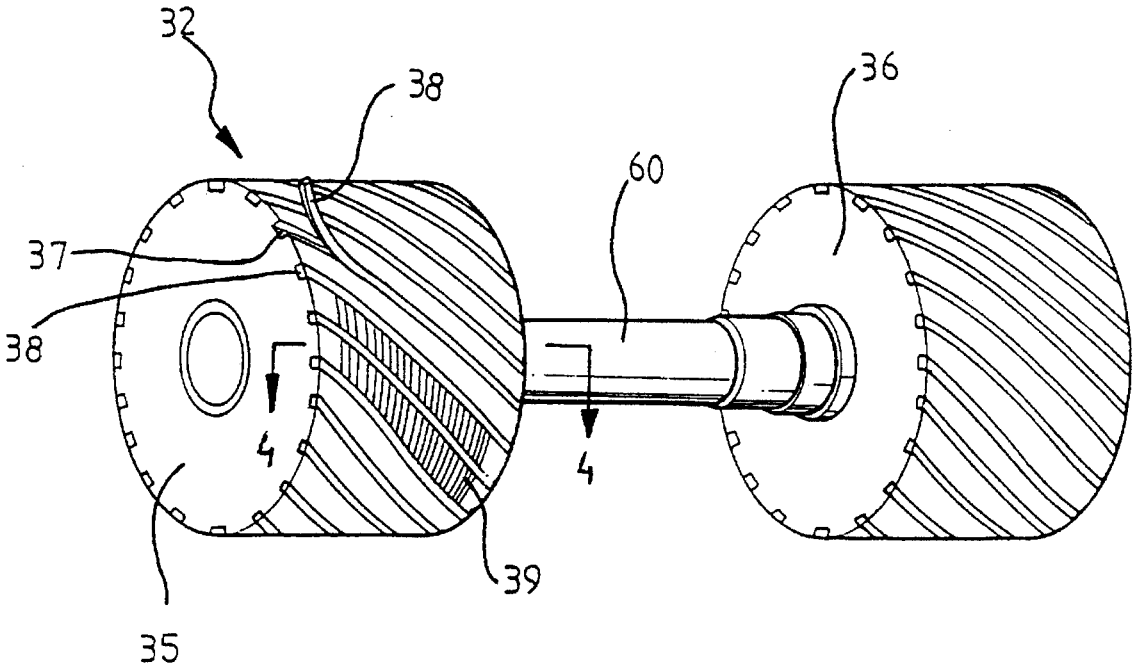
FIG. 3 is a perspective view of the front top roller of the front roller part according to the present invention.

The front top roller 32 is made of rubber, and the surface of the rubber groove rollers 35 and 36 has a cylindrical shape. However, in this invention, the front top roller 32 has a structure that multiple grooves 39 which are perpendicular to the axis of the roller 32 are formed on the surface of the rubber groove rollers 35 and 36. Each groove 39 has a width of about 0.15 mm, a length of about 5.5 mm, and a depth of about 0.6 mm. About fifty to sixty grooves 39 per one inch are formed on the surface of the rubber groove rollers 35 and 36. FIG. 3 is a perspective view of an embodiment of the front top roller 32 according to this invention. However, it is very difficult to form grooves 39 on the surface of the rubber groove rollers 35 and 36, which have a dimension of a width of about 0.15 mm, a length of about 5.5 mm, and a depth of about 0.6 mm. Therefore, multiple grooves which have a dimension of a width of about 0.15 mm and a depth of about 0.6 mm are formed along the surface of the rubber groove rollers 35 and 36 at circular types. About fifty to sixty multiple circular grooves per one inch are formed on the surface of the rubber groove rollers 35 and 36. Secondly, multiple slanting grooves 37 which are slanted at about 45° to the axis of the front top roller 32 or to the mutiple grooves 39 are formed on the surface of the rubber groove rollers 35 and 36. The multiple slanting grooves 37 have a dimension of a width of about 2.0 mm and a depth of 1.5 min. In the conventional drafting systems, the diameter of the rubber groove rollers 35 and 36 is about 50 mm. In the rubber groove rollers with a diameter of 50 mm, about twenty slanting grooves 37 are formed on the surface of the rubber groove rollers 35 and 36. Then, finally an abrasion resistant filler 38 is inserted and fixed in a slanting groove 37. The height of the abrasion resistant filler 38 is 1.5 mm which is same as the depth of the slanting groove 37. The abrasion resistant filler 38 may be made of a polyurethane resin or a material with a high abrasion resistance. Accordingly, the front top roller 32, which is prepared by forming multiple circular grooves on the surface of the rubber groove rollers 35 and 36, forming multiple slanting grooves 37, and inserting the abrasion resistant fillers 38 in the multiple slanting grooves 37, has the same effect as a front top roller on which multiple grooves 39 with a dimension of a width of about 0.15 mm, a length of about 5.5 mm and a depth of about 0.6 mm are formed slantingly at about 45° to the axis of the front top roller 32, as illustrated in FIG. 2. FIG. 2 is a perspective view of another embodiment of the front top roller 32, even if it is very difficult to groove the multiple grooves 39.

Figure 4:
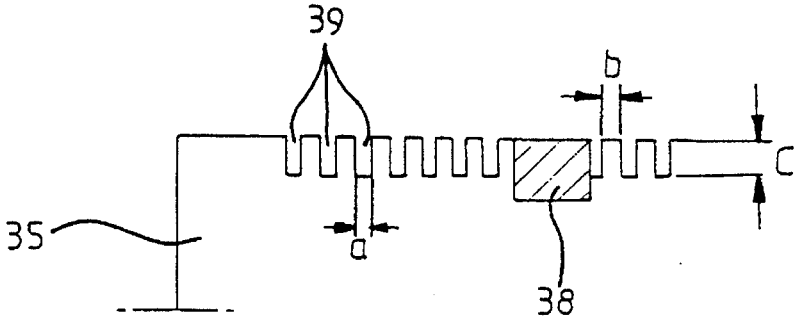
FIG. 4 is a cross-sectional view taken from the line 4—4 of FIG. 3.
Figure 5:
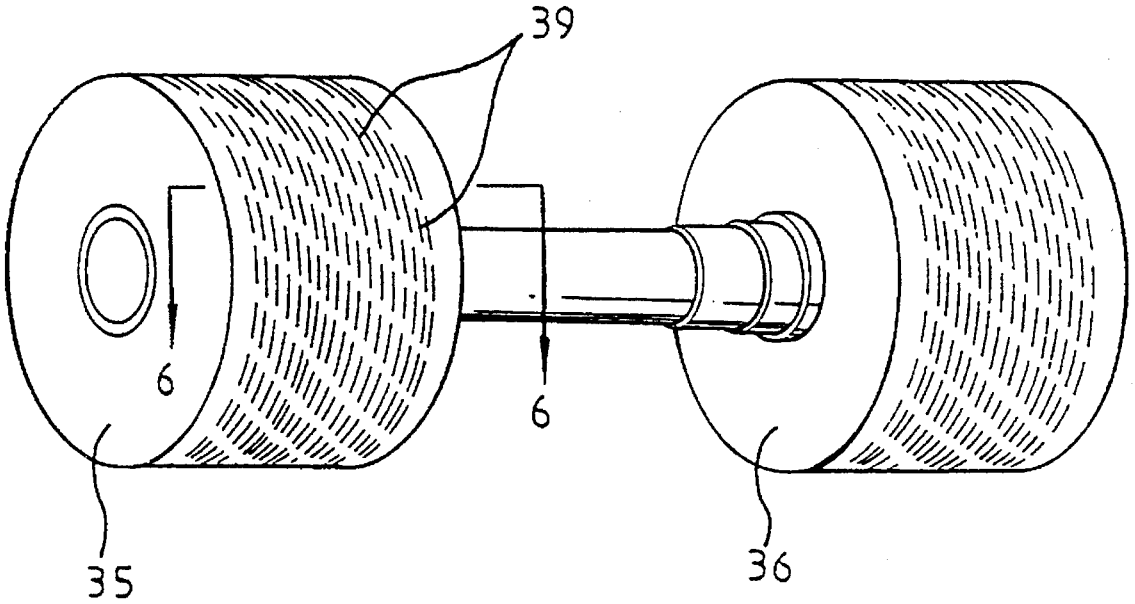
FIG. 5 is a perspective view of another enbodiment of the front top roller according to the present invention.
Figure 6:
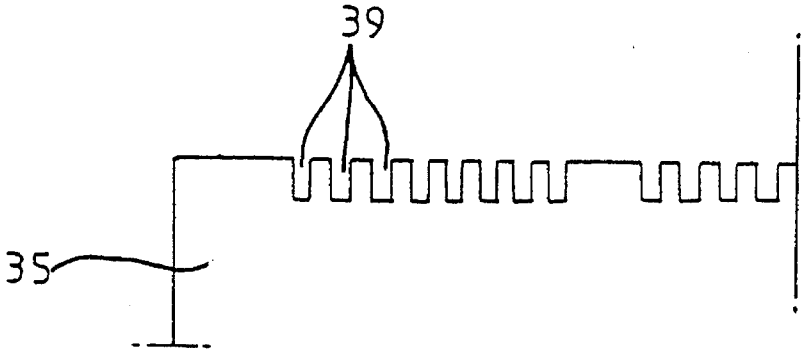
FIG. 6 is a cross-sectional view taken from the line 6—6 of FIG. 5.

FIG. 4 is a cross-sectional view taken from the line 4—4 of FIG. 3, and FIG. 6 is a cross-sectional view taken from the line 6—6 of FIG. 5. In FIG. 4, the width(a) of the groove 39 is about 0.5 mm, the distance(b) between the grooves 39 is about 0.35 mm, and the depth(c) of the groove 39 is about 0.6 mm.

When a wool roving is passing between the front bottom roller 31 and the front top roller 32, the roving contacts between the drafting surfaces 34 and the rubber groove rollers 35 and 36 of the front top roller 32. The roving is less drafted at the contacting points between the multiple grooves 39 of the front top roller 32 and the front bottom roller 31 than at the contacting points between the other surface of the front top roller 32 and the front bottom roller 31. In other words, the roving passing between the other surface of the front top roller 32 and the front bottom roller 31 has larger draft ratio than the roving passing between the multiple grooves 39 of the front top roller 32 and the front bottom roller. 31. Accordingly uniform bulky loops are formed in the bundle of the wool spun yarn. Also the multiple grooves 39 arranged slantingly at about 45° to the axis of the front top roller 32 change periodically the contacting points of the roving so as to help the formation of the bulky loops.

Figure 7A:
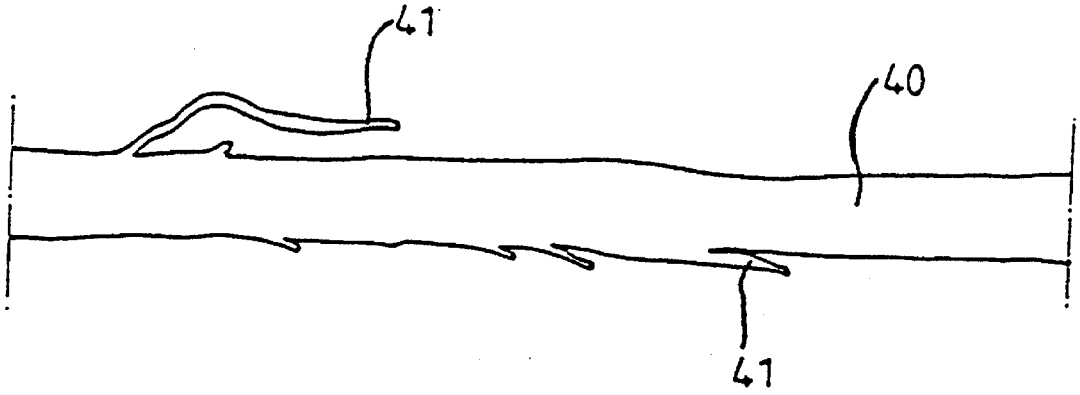
FIG. 7A PRIOR ART
FIG. 7(A) is an enlarged plan view of a conventional wool spun yarn.
Figure 7B:
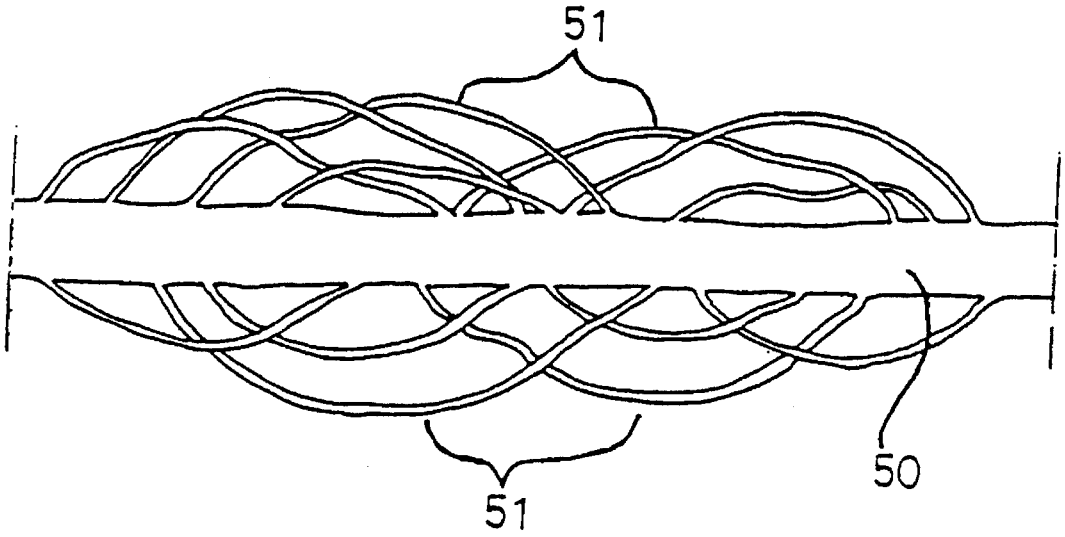
FIG. 7B PRIOR ART
FIG. 7(B) is an enlarged plan view of a high bulky wool spun yarn of the present invention.

FIG. 7(A) is an enlarged plan view of a conventional wool spun yarn, and FIG. 7(B) is an enlarged plan view of a high bulky wool spun yarn according to the present invention. The conventional wool spun yarn has fibrils 41 in the bundle 40 of a yarn. The fibrils cause a pilling phenemenon on a knitting or weaving fabric. Also the conventional wool spun yarn does not have a bulky loop in the bundle 40. However, the wool spun yarn has bulky loops 51 which are uniformly formed in the bundle 50 of the yarn. In addition, the wool spun yarn has much less fibrils than the conventional wool spun yarn, thereby not causing a pilling phenomenon. The uniform bulky loops 51 render a high bulkiness, a soft touchness, and other advantages to a wool spun yarn or a knitting or weaving fabric.

The front top roller 32 of the present invention may be substituted with a conventional top roller, which is easily carried out to a skilled person in this technical field.

EXAMPLES

A conventional front top roller was substituted with a front top roller according to the present invention in a conventional spinning machine. A high bulky wool spun yarn was prepared under the same conditions as a conventional wool spun yarn. The volume and weight of the high bulky wool spun yarn was compared with those of a conventional wool spun yarn. The bulkiness for the high bulky wool spun yarn and conventional wool spun yarn was observed with a microscope. Further the pilling phenomenon was tested for plain fabrics of the high bulky wool spun yarn and conventional wool spun yarn.

(1) Volume and Weight

The cones for the high bulky wool spun yarn and conventional wool spun yarn were prepared to have the same volumes, which are observed with human eyes. The weights of the cones were measured. The weight of the high bulky wool spun yarn to the weight of the conventional wool spun yarn was 1 to 1.5~2.0.

(2) Bulkiness

The schematic view of the conventional wool spun yarn is shown as FIG. 7(A), and the schematic view of the high bulky wool spun yarn is shown as FIG. 7(B).

(3) Pilling Test

The plain fabrics of the high bulky wool spun yarn and conventional wool spun yarn were prepared with the yarns of 2/32 Nm×1, 12 gauges, and a cover factor of 0.43. The pilling phenomenon was tested by the ICI BOX method. The pilling grade was 4 after 2 hours, and 3 after 4 hours. The pilling grade for the fabric with a cover factor of 0.38 was 3~4 after 2 hours, and 4 after 4 hours. The pilling grade for the high bulky wool spun yarn was improved by one grade more than that for the conventional wool spun yarn.

What is claimed is:

1. A drafting roller assembly for a spinning machine, the drafting roller assembly comprising:

a back roller part;

a middle roller part; and a front roller part, said front roller part consists of a front bottom roller, a front top roller assembly, and a cleaning roller, said front top roller assembly having at least one groove roller having a top surface, at least one of said groove rollers having multiple grooves and multiple slanting grooves formed on said top surface, said multiple grooves being formed generally perpendicular to the axis of the front top roller assembly and said multiple slanting grooves being formed at a slant of about 45° relative to the axis of said front top roller assembly; and at least one of said multiple slanting grooves having an abrasion resistant filler inserted and fixed therein.

2. The drafting roller assembly of claim 1 wherein each of said groove rollers is made from a rubber like material, has between about fifty to sixty multiple grooves formed per one inch, and each multiple groove having a width of about 0.15 mm, a length of about 5.5 mm, and a depth of about 0.6 mm.

3. The drafting roller assembly of claim 1 wherein each of said groove rollers is made from a rubber material, has about twenty multiple slanting grooves formed thereon, and each multiple slanting groove being formed having a width of about 2.0 mm and a depth of about 1.5 mm.

4. The drafting roller assembly of claim 1 wherein the height of the abrasion resistant fillers is no less than the depth of the slanting grooves.

5. The drafting roller assembly of claim 1 wherein said abrasion resistant fillers are made of a polyurethane resin material.

6. A drafting roller assembly for a spinning machine, the drafting roller assembly comprising:

a back roller part;

a middle roller part; and a front roller part, said front roller part consists of a front bottom roller, a front top roller assembly, and a cleaning roller, said front top roller assembly further comprising at least one groove roller having a top surface, at least one of said groove rollers having multiple grooves formed on said top surface slantingly at about 45° relative to the axis of the front top roller assembly.

7. The drafting roller assembly of claim 6 wherein each of said groove rollers is made from a rubber material, has between about fifty to sixty multiple grooves formed per one inch, and each multiple groove having a width of about 0.15 mm, a length of about 5.5 mm, and a depth of about 0.6 mm.

8. A process of preparing a high bulky wool spun yarn comprising the steps of:

(a) providing a spinning machine comprising a back roller part;

a middle roller part;

a front roller part, said front roller part consists of a front bottom roller, a front top roller assembly, and a cleaning roller, said front top roller assembly having at least one groove roller-having a top surface, at least one of said groove rollers having multiple grooves and multiple slanting grooves formed on said top surface, said multiple grooves being formed generally perpendicular to the axis of the front top roller assembly, and said multiple slanting grooves being formed at a slant of about 45° relative to the axis of said front top roller assembly, at least one of said multiple slanting grooves having an abrasion resistant filler inserted and fixed therein;

(b) providing a wool roving; and (c) passing said wool roving through said middle roller part and said front roller part such that bulky loops are formed on said roving.

9. The method of claim 8 wherein the step of providing said spinning machine further comprises:

providing groove rollers made of a rubber like material, said groove rollers having between about fifty to sixty multiple grooves formed per one inch and each multiple groove formed having a width of about 0.15 mm, a length of about 5.5 mm, and a depth of about 0.6 mm.

10. The method of claim 8 wherein the step of providing said spinning machine further comprises:

providing groove rollers made from a rubber material, said groove rollers having about twenty multiple slanting grooves formed thereon and each multiple slanting groove formed having a width of about 2.0 mm and a depth of about 1.5 mm.

11. The method of claim 8 wherein the step of providing said spinning machine further comprises:

providing abrasion resistant fillers having a height that is no less than the depth of the slanting grooves.

12. The method of claim 8 wherein the step of providing said spinning machine further comprises:

providing abrasion resistant fillers made of a polyurethane resin material.

13. A process of preparing a high bulky wool spun yarn comprising the steps of:

(a) providing a spinning machine comprising:

a back roller part;

a middle roller part;

a front roller part, said front roller part consists of a front bottom roller, a front top roller assembly, and a cleaning roller, said front top roller assembly having at least one groove roller having a top surface, at least one of said groove rollers having multiple grooves formed on said top surface at a slant of about 45° relative to the axis of said front top roller assembly, at least one of said multiple slanting grooves having abrasion resistant fillers inserted and fixed therein;

(b) providing a wool roving; and (c) passing said wool roving through said middle roller part and said front roller part such that bulky loops are formed on the roving.

14. The method of claim 13 wherein the step of providing said spinning machine further comprises:

providing groove rollers made of a rubber material, said rollers having between about fifty to sixty multiple grooves formed per one inch and each multiple groove formed having a width of about 0.15 mm, a length of about 5.5 mm, and a depth of about 0.6 mm.

15. The method of claim 13 wherein the step of providing said spinning machine further comprises:

providing abrasion resistant fillers having a height that is no less than the depth of the slanting grooves.

16. The method of claim 13 wherein the step of providing said spinning machine further comprises:

providing abrasion resistant fillers made of a polyurethane resin material.

* * * * *